US005601136A

United States Patent [19]

Shimmell

[11] Patent Number: 5,601,136

[45] Date of Patent: Feb. 11, 1997

[54] INCLINED DIE CAST SHOT SLEEVE SYSTEM

[75] Inventor: Dennis S. Shimmell, Hudsonville, Mich.

[73] Assignee: Nelson Metal Products Corporation, Grandville, Mich.

[21] Appl. No.: 468,256

[22] Filed: Jun. 6, 1995

[51] Int. Cl.[6] ..... B22D 17/10

[52] U.S. Cl. ..... 164/312; 164/113

[58] Field of Search ..... 164/312, 314, 164/113

[56] References Cited

U.S. PATENT DOCUMENTS

| | | | |
|---|---|---|---|
| 359,757 | 3/1887 | Wicks . | |
| 2,137,764 | 11/1938 | Wagner . | |
| 2,972,172 | 2/1961 | Federman . | |
| 3,019,495 | 2/1962 | Cornell . | |
| 3,292,218 | 12/1966 | Kozma . | |
| 3,646,990 | 3/1972 | Cross . | |
| 3,672,440 | 6/1972 | Miura et al. | 164/312 |
| 3,791,440 | 2/1974 | Cross . | |
| 3,810,505 | 5/1974 | Cross . | |
| 4,178,983 | 12/1979 | Mochizuki et al. | 164/113 |
| 4,436,140 | 3/1984 | Ebisawa et al. . | |
| 4,505,318 | 3/1985 | Tokui et al. . | |
| 4,519,436 | 5/1985 | Ebisawa et al. . | |
| 4,614,630 | 9/1986 | Pluim, Jr. . | |
| 4,730,658 | 3/1988 | Nakano . | |

FOREIGN PATENT DOCUMENTS

| | | |
|---|---|---|
| 0565457 | 3/1960 | Belgium . |
| 0935147 | 10/1955 | Germany . |
| 0196159 | 11/1983 | Japan . |
| 0102259 | 6/1985 | Japan . |
| 0168897 | 10/1959 | Sweden . |

*Primary Examiner*—Kuang Y. Lin
*Attorney, Agent, or Firm*—Warner Norcross & Judd

[57] ABSTRACT

A die casting system having an inclined shot sleeve. A pour hole is located in the upper end of the inclined sleeve. The size, shape, and position of the pour hole and the inclination of the shot sleeve are selected so that, when the sleeve is filled to capacity, the volume of air remaining in the sleeve equals the volume of material displaced by the plunger as it closes the pour hole. As the plunger is advanced, the air in the shot sleeve is expelled through the pour hole; and preferably the last air is expelled just as the pour hole is closed.

14 Claims, 3 Drawing Sheets

INCLINED DIE CAST SHOT SLEEVE SYSTEM

BACKGROUND OF THE INVENTION

The present invention relates to die casting equipment, and more particularly to shot system through which molten metal is transferred into a die.

Die casting is used to fabricate a multitude of metal articles ranging from automotive parts to children toys. A typical die casting machine includes a pair of die halves each formed with a void corresponding to a portion of the article to be cast. When the two die halves are brought together in proper alignment, their respective voids cooperate to form a die cavity corresponding to the shape of the article to be cast. Molten metal is introduced into the die cavity and allowed to cure-typically by cooling the molten metal until it solidifies. Once the metal is sufficiently cured, the die halves are opened and the cast article is removed from the die cavity. The die halves can be reclosed and the process repeated to form the desired number of identical articles.

A common method for introducing molten metal into the die cavity is to use a shot sleeve assembly including a shot sleeve and a reciprocating plunger. The shot sleeve includes a pour hole and an internal bore communicating with the die cavity. The molten metal to be injected into the die cavity is ladled through the pour hole into the sleeve. The plunger travels within the sleeve to inject or force the molten metal out of the sleeve and into the die cavity. After the "shot," the plunger is retracted to permit the sleeve to be filled for the next shot.

In a typical die casting environment, the sleeve is only partially filled with the volume of metal corresponding to the volume of the die cavity. A shot with a partially filled sleeve is called an "open shot." During an open shot, a turbulent wave forms in front of the plunger as it advances. This wave creates and entraps air bubbles within the molten metal, ultimately resulting in a porous casting.

To produce higher quality castings, "closed shot" assemblies have been developed. A closed shot sleeve has a volume corresponding to the volume of the die cavity. Consequently, the sleeve is completely filled with molten metal and the pour hole is closed before the plunger advances.

A unique and ingenious closed shot system is disclosed in U.S. Pat. No. 5,205,338 issued Apr. 27, 1993 to Shimmell. A filling cylinder intersects the shot sleeve and includes a reciprocating slide valve. After the shot sleeve is filled with molten metal, the slide valve is actuated to seal off the filling hole in the shot sleeve. Consequently, the shot sleeve is completely filled and sealed prior to the advancement of the plunger. While a significant advance in the art, the closed shot sleeve system of the '338 patent requires relatively complex machining in its manufacture. Further, the arrangement includes a number of moving parts that are subject to wear and fatigue.

SUMMARY OF THE INVENTION

The aforementioned problems are overcome by the present invention wherein the shot sleeve system includes a shot sleeve inclined from the horizontal downwardly from the pour hole. Molten metal poured into the sleeve through the pour hole fills the sleeve from the lower end up to the pour hole, leaving only a small amount of air within the sleeve in the immediate area of the pour hole. The shape and position of the pour hole are selected in combination with the inclination of the shot sleeve so that, when filled to the pour hole, the volume of air remaining in the sleeve will equal the volume of metal displaced by the plunger as it closes the pour hole. As the plunger advances, the air in the sleeve is expelled through the pour hole. Because the volume of air in the shot sleeve is equal to the volume displaced by the plunger as it seals the pour hole, the air is completely expelled from the sleeve just as the pour hole is sealed.

The present invention provides a shot sleeve capable of delivering a fixed-volume shot with a single moving part (i.e. the plunger). Because all of the air is expelled from the shot sleeve as the plunger advances, unwanted porosity in the cast article is reduced. Any air trapped within the molten metal will remain adjacent the plunger and be ejected from the shot sleeve at the end of the shot. As a result, this potentially porous metal does enter the die cavity, but is only in the biscuit area of the article.

In the preferred embodiment, the pour hole includes a spillway on one side. The spillway precisely defines the filling extent of the sleeve by allowing molten metal to spill from the sleeve after the desired volume has been reached. Further preferably, the sleeve may be rotated to adjust the position or height of the spillway to "fine tune" the fill volume of the sleeve.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
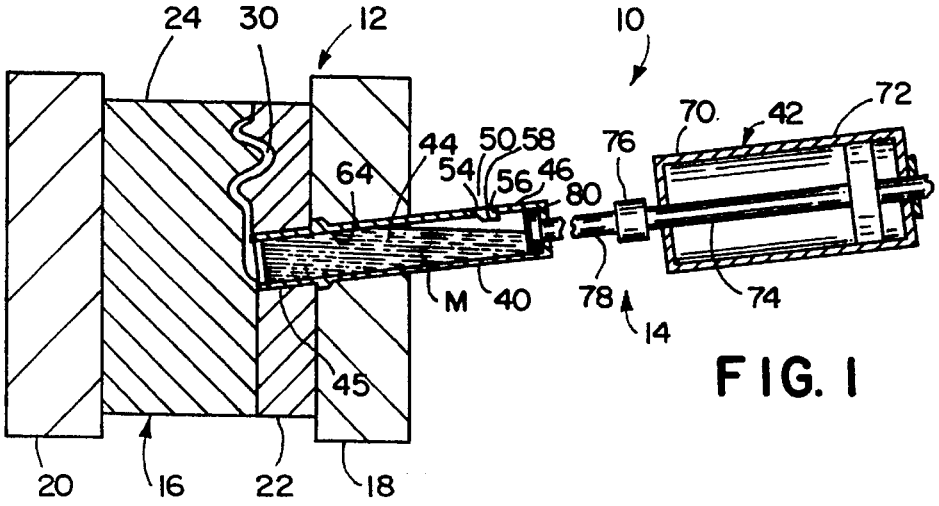
FIG. 1 is a sectional, side elevational view of a die casting apparatus according to the present invention.

A die casting apparatus incorporating a shot sleeve system according to a preferred embodiment of the invention is illustrated in FIG. 1, and generally designated 10. The apparatus includes a die assembly 12 and a metal delivery system 14. Molten metal is ladled into the metal delivery system and then forced into the die to create cast metal articles.

The die assembly 12 includes a die 16 sandwiched between a pair of platens 18 and 20. Platen 18 is stationary and is connected directly to the metal delivery system 14. Platen 20 is movable with respect to platen 18 to allow cast articles to be removed from the die 16. The movable platen 20 is mounted to conventional hydraulic means (not shown) to provide appropriate movement. The die 16 includes a cover die 22 mounted to the stationary platen 18 and an ejector die 24 mounted to the movable platen 20. The inner surface 26 of the cover die 22 is contoured to match a first portion of the profile of the article to be cast. Likewise, the inner surface 28 of the ejector die 24 is contoured to match a second portion of the profile of the article. Consequently, when the two dies 22 and 24 are brought into proper alignment, the contours cooperate to form a void, or die cavity 30, which defines the shape of the article to be cast.

The metal delivery system 14 includes a shot sleeve 40 B for receiving molten metal and an ejection system 42 for forcing the molten metal from the shot sleeve 40 into the die cavity 30. The shot sleeve 40 is generally cylindrical and includes a circumferential wall 41 defining a concentric internal bore 44 that is in fluid communication with the die cavity 30. The shot sleeve 40 also includes forward or lower end 45 and a rearward or upper end 46. The lower end 45 is mounted directly to the stationary platen 18 and cover die 22. The shot sleeve is tilted or inclined from the horizontal with the rearward end 46 extending above the forward end 45. In the disclosed and presently preferred embodiment, the shot sleeve is inclined approximately 7.5 degrees from level. The sleeve alone may be inclined (as illustrated in FIG. 1); or the entire die-casting machine may be inclined, leaving the sleeve perpendicular to the platen 18 (not illustrated).

Figure 2:
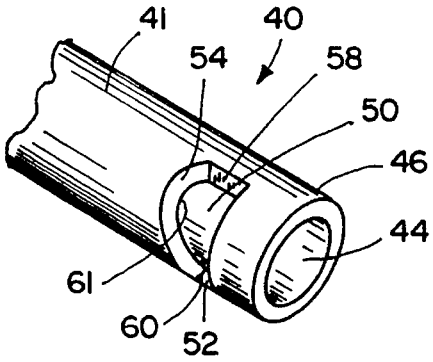
FIG. 2 is a perspective view of a portion of the shot sleeve showing the pour hole.
Figure 3:
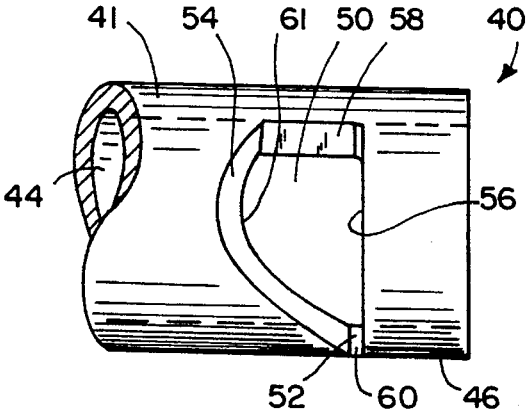
FIG. 3 is a top plan view of the portion of the shot sleeve showing the pour hole.
Figure 4:
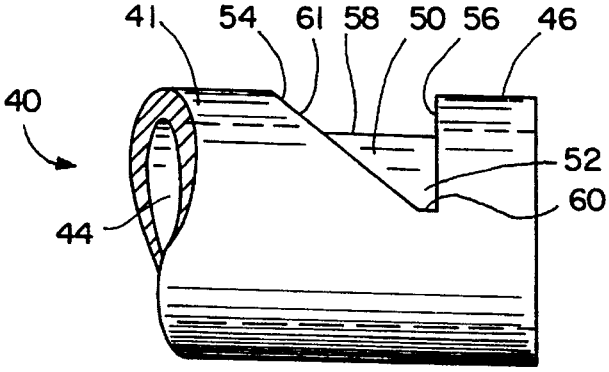
FIG. 4 is a side elevational view of the portion of the shot sleeve showing the pour hole.

As perhaps best illustrated in FIGS. 2–4, the shot sleeve 40 defines a pour hole 50 near upper end 46. The pour hole 50 allows molten metal to be ladled into bore 44. In addition, the pour hole 50 is shaped to define a spillway 52 for allowing molten metal to spill from the shot sleeve after the desired volume has been introduced into the sleeve. The pour hole 50 and spillway 52 include a forward edge 54, a rearward edge 56, an upper side edge 58, and a lower side edge 60. The forward edge 54 is defined along a plane obliquely intersecting the shot sleeve while the rearward edge 56 is defined along a plane perpendicularly intersecting the shot sleeve. The upper and lower side edge 58 and 60 extend between the forward and rearward edges. The lower side edge 60 is lower on the shot sleeve than the upper side edge 58. As a result, metal will spill out over the lower side edge upon overfilling; and the lower side edge 58 with portions of the forward and rearward edges 54 and 56 forms a spillway 52.

Figure 5:
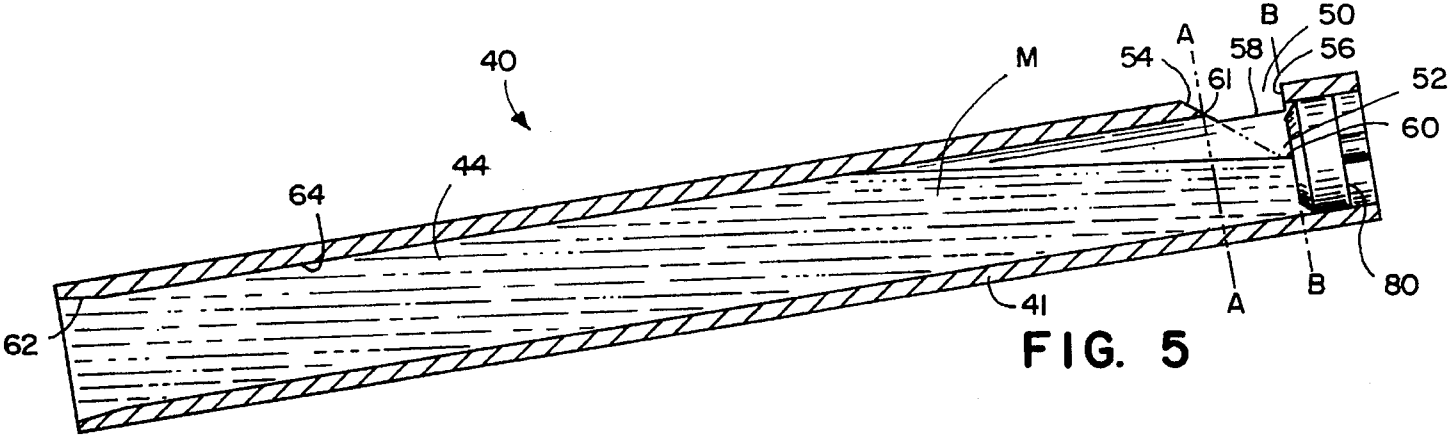
FIG. 5 is a sectional, side elevational view of the shot sleeve with the plunger in the retracted or fill position.

At the lower end 45 of the sleeve 40 (FIG. 5), a chamfer 62 is formed along the inner surface 64 of the shot sleeve 40. The angle of the chamfer 62 is equal to the angle of the incline of the shot sleeve 40. This chamfer 62 helps to allow the cast article to be removed from the die cavity as discussed below.

The plunger actuator system 42 includes a hydraulic shot cylinder 72, a rod 74, a crosshead adapter 76, a plunger rod 78, and a plunger tip 80. The shot cylinder 72 is axially aligned with the shot sleeve 40 and operates to provide rod 74 with reciprocating motion. Rod 74 is connected to plunger rod 78 by crosshead adapter 76 to impart reciprocating motion to plunger rod 78 and plunger 80. The tip of the plunger 80 (see FIG. 9) is chamfered 82. Like chamfer 62, chamfer 82 helps to allow the cast article to be removed from the die cavity 30 as will be described below.

The angle of incline of the shot sleeve 40 and the shape and position of the pour hole 50 are selected such that air, and preferably essentially all of the air, contained in the shot sleeve is forced out through the pour hole as the plunger is advanced. At the same time, however, the volume of molten metal in the sleeve 40 preferably is selected so that no metal spurts from the pour hole as the plunger advances. To accomplish this, two conditions must exist. (They both occur together.) First, the volume of air in the shot sleeve when the plunger is aligned with the rearward edge 56 of the pour hole must equal the volume displaced by the plunger as it closes the pour hole 50. Second, the volume of air contained forwardly of the forward extent 61 of the pour hole must equal the volume of metal contained rearwardly of the forward extent 61 when the plunger 80 is aligned with the rearward edge 56. This is illustrated in FIG. 4.

Line A—A represents a plane extending perpendicularly to the axis of the shot sleeve 40 at the forward extent 61 of the pour hole 50. Similarly, line B—B represents a plane extending perpendicularly to the axis of the shot sleeve 40 at the rearward edge 56 of the pour hole 50. The volume of air bounded by the inner surface 64, molten metal M, and the plane represented by line B—B must be substantially equal to the volume of bore 44 bounded by the plane represented by line A—A and the plane represented by B—B. Because these two volumes have portions of overlap, another method for providing the necessary geometry is for the volume of air bounded by the inner surface 64, the plane defined by the surface of molten metal M, and the plane represented by line A—A to be substantially equal to the volume of molten metal contained within bore 44 between the plane represented by line A—A and the plane represented by B—B.

In addition, the angle of forward edge 54 preferably is selected so that no molten metal spills from the shot sleeve as the plunger advances to close the pour hole. As illustrated in FIGS. 5–8, the level of molten metal will rise as the plunger advances to close the pour hole 50. If the angle of forward edge 54 is too flat, the molten metal will spill from the pour hole as it rises. If the angle is too severe, the pour hole is narrow; and ladling molten metal into the shot sleeve can be difficult. In the preferred embodiment, the forward edge 54 is inclined approximately 40 degrees upwardly from the axis of the shot sleeve 40.

In the preferred embodiment, the shot sleeve 40 is rotatably mounted to the die assembly 12 so that it can be rotated to provide fine adjustment of the height of the spillway 52, and consequently, the maximum volume of molten metal in the shot sleeve. For example, the shot sleeve can be rotated to lower the spillway 52 and reduce the capacity of the shot sleeve 40, or rotated to raise the spillway 52 and increase the capacity of the shot sleeve 40.

Operation

Initially, cover die 22 and ejector die 24 are mounted to stationary and movable platens 18 and 20, respectively, and the die is closed to form die cavity 30. In addition, the plunger 80 is retracted at least to the rearward edge 56 of the pour hole 50 by operation of shot cylinder 72. At this point, the shot sleeve 40 is ready to receive molten metal.

Molten metal is ladled into the shot sleeve through pour hole 50 until the internal bore 44 is filled and molten metal begins to spill from spillway 52. In effect, spillway 52 functions to prevent the internal bore 44 from being over-filled. A receptacle (not shown) is positioned to catch molten metal spilling out spillway 52 for reuse. If plunger 80 is retracted beyond the rearward edge 56 of the pour hole, additional molten metal will spill from the spillway 52 as the plunger 80 is advanced to the rearward edge 56.

Figure 6:
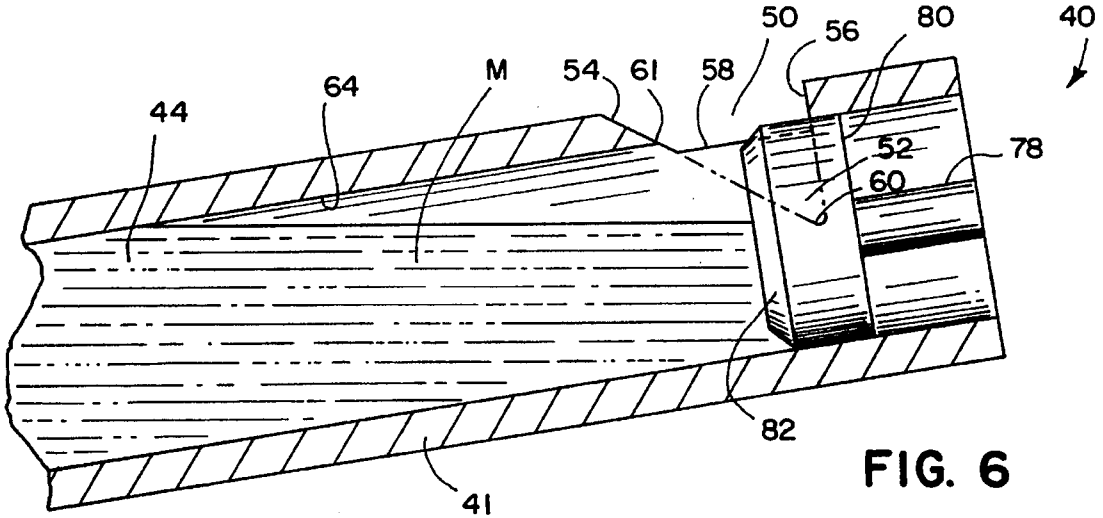
FIG. 6 is a sectional, side elevational view of a portion of the shot sleeve with the plunger partially advanced from the fill position.
Figure 7:
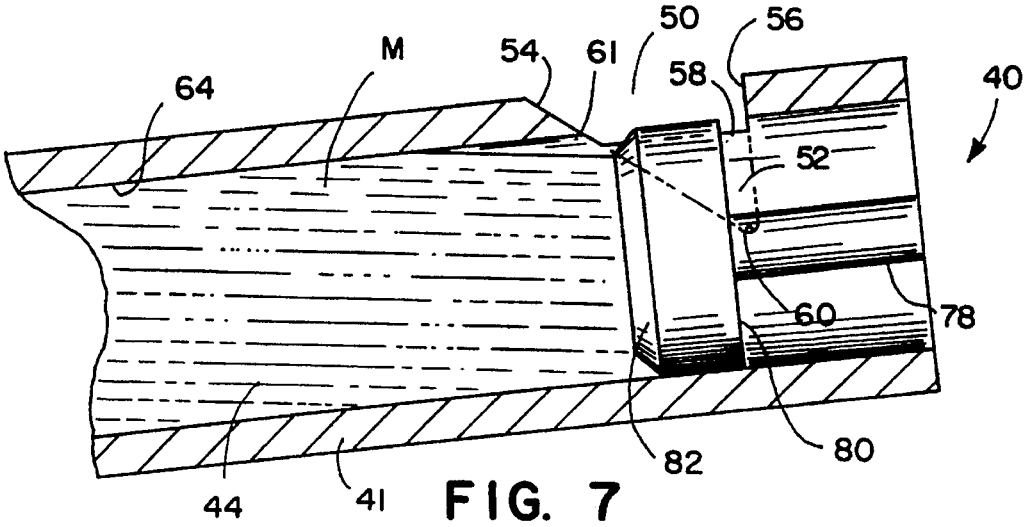
FIG. 7 is a sectional, side elevational view of a portion of the shot sleeve with the plunger further partially advanced from the fill position.
Figure 8:
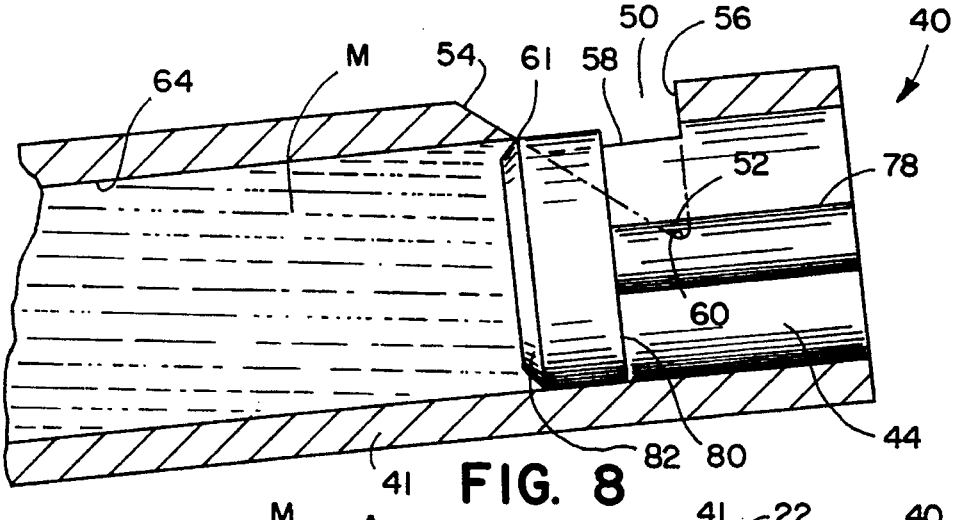
FIG. 8 is a sectional, side elevational view of a portion of the shot sleeve with the plunger further partially advanced to the point where the pour hole is sealed.

FIGS. 5–8 illustrate four stages in the advancement of the plunger 80 to close the pour hole 50. The illustrations begin with FIG. 5 wherein the plunger 80 is aligned with the rearward edge 56 of the pour hole 50. As shown, the molten metal M will fill bore 44 up to spillway 52. FIG. 6 illustrates the plunger 80 advanced slightly ahead of the rearward edge 56 with the level of molten metal rising upwardly to partially expel the air within the bore 44. As the plunger moves forward, it seals the pour hole at an increasing height to contain the rising metal. FIG. 7 illustrates the plunger 80 advanced almost entirely across the pour hole 50. As can be seen, the molten metal has risen substantially; and the air is almost entirely expelled from the bore 44. And finally, FIG. 8 shows the plunger 80 advanced entirely across the pour hole 50. This view illustrates that the molten metal has risen upwardly to expel all of the air from the bore 44. Again, preferably the last of the air is expelled just as the plunger tip closes the pour hole. As a result, the shot sleeve 40 contains a substantially air-free, fixed-volume, closed shot.

The plunger 80 continues to advance by operation of shot cylinder 72 beyond the forward edge 54 to force the molten metal into the die cavity 30. Once the plunger 80 is fully extended, the molten metal is allowed to cure. Optionally, high pressure may be developed in the molten metal for squeeze casting.

Figure 9:
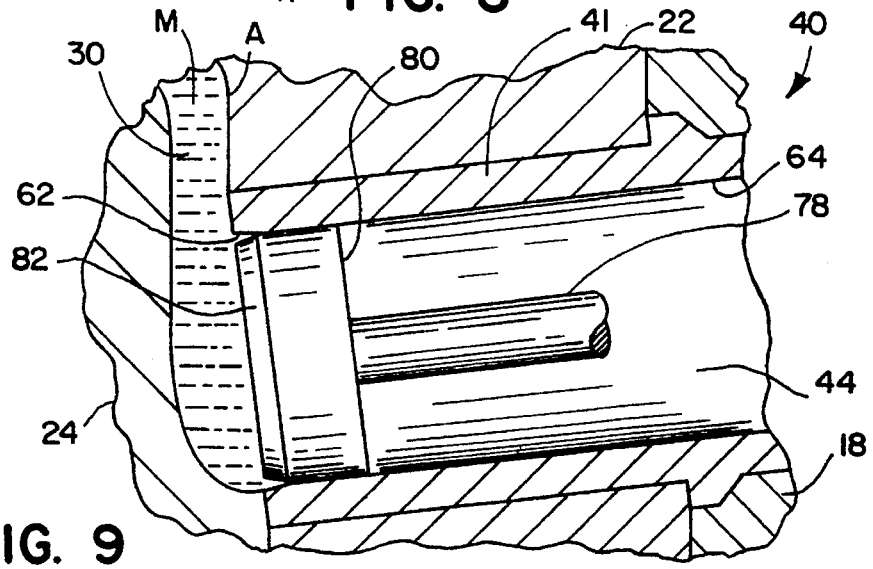
FIG. 9 is a sectional side elevational view of the lower end of the shot sleeve with the plunger fully advanced to the extended or finished position.

After the article A is sufficiently cured, typically through cooling, the ejector die 24 and cover die 22 are separated to provide access to the cast article A. As shown in FIG. 9, the chamfer 82 on the plunger 80 and the chamfer 62 within the shot sleeve 40 allow the biscuit B of the article A to be removed horizontally from the inclined sleeve 40. Without these chamfers 62 and 82, the article may be caught on the bottom edge of the plunger 80 or inner surface 64 at the top of the shot sleeve 40.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are defined as follows:

1. A die casting material delivery system comprising:

a shot sleeve inclined from the horizontal and having an upper end and a lower end, said sleeve defining an internal bore and a pour hole communicating with said bore, said pour hole proximate said upper end of said sleeve and having a forward extent a rearward extent, and a lower extent; and a plunger means for ejecting molten material from said bore, said plunger means including a tip and being movable in a linear direction between (a) a retracted position in which said tip is aligned with said rearward extent of said pour hole such that said pour hole is open and (b) an extended position in which said tip is generally aligned with said forward extent of said pour hole such that said pour hole is closed, said shot sleeve defining a first volume above a first horizontal plane through said lower extent and forward of a second plane through said rearward extent, said shot sleeve defining a second volume between said second plane and a third plane through said forward extent, both of said second and third planes being generally perpendicular to said direction, said first volume and said second volume being generally equal, whereby, when said bore is filled with molten metal up to said lower extent of said pour hole and said plunger means is in said retracted position, substantially all air is displaced through said pour hole as said tip moves from said retracted position to said extended position without causing metal to spurt from said pour hole.

2. A die casting material delivery system comprising:

a shot sleeve inclined from tile horizontal and having an upper end and a lower end, said sleeve defining an internal bore and a pour hole communicating with said bore, said pour hole proximate said upper end of said sleeve and having a forward extent, a rearward extent, and a lower extent, said pour hole defining a spillway including said lower extent, said spillway allowing excess molten material to spill from said shot sleeve; and a plunger means for ejecting molten material from said bore, said plunger means including a tip and being movable in a linear direction between (a) a retracted position in which said tip is aligned with said rearward extent of said pour hole such that said pour hole is open and (b) an extended position in which said tip is generally aligned with said forward extent of said pour hole such that said pour hole is closed, said shot sleeve defining a first volume above a first horizontal plane through said lower extent, said shot sleeve defining a second volume between second and third planes through said forward extent and said rearward extent respectively, both of said second and third planes being generally perpendicular to said direction, said first volume and said second volume being generally equal, whereby, when said bore is filled with molten metal up to said lower extent of said pour hole and said plunger means is in said retracted position, substantially all air is displaced through said pour hole as said tip moves from said retracted position to said extended position.

3. The system of claim 2 wherein said plunger tip is chamfered at an angle generally equal to the angle of inclination of said shot sleeve.

4. The system of claim 3 wherein said shot sleeve includes an inner surface chamfered at said lower end at an angle generally equal to the angle of inclination of said shot sleeve.

5. The system of claim 3 wherein said shot sleeve includes a shot volume, said shot sleeve being rotatable to allow adjustment of said shot volume.

6. A shot sleeve system for delivering molten material to a die cavity comprising:

a shot sleeve inclined from the horizontal and having an upper end and a lower end, said sleeve having a longitudinal axis, said sleeve defining an internal bore and a pour hole communicating with said bore, said pour hole having a forward extent, a rearward extent, and a lower extent; and a plunger means for ejecting molten material from said bore, said plunger means movable between a retracted position wherein said pour hole is unrestricted and an extended position toward said lower end of said shot sleeve, said shot sleeve defining a first volume above a first horizontal plane through said lower extent and forward of a second plane through said forward extent and generally perpendicular to said sleeve axis, said sleeve defining a second volume below said first plane and between said second plane and a third plane through said rearward extent and generally perpendicular to said sleeve axis, said first and second volumes being generally equal, whereby, when said sleeve is filled with molten metal to said lower extent of said pour hole, subsequent movement of said plunger from said retracted position to said extended position causes the molten metal within said second volume to displace any air within said first volume without causing metal to spurt from said pour hole.

7. A shot sleeve system for delivering molten material to a die cavity comprising:

a shot sleeve inclined from the horizontal and having an upper end and a lower end, said sleeve having a longitudinal axis, said sleeve defining an internal bore and a pour hole communicating with said bore, said pour hole having a forward extent, a rearward extent, and a lower extent, said pour hole defining a spillway having a lower extent aligned with said rearward extent along a plane generally perpendicular to said sleeve axis, said spillway allowing excess molten material to spill from said shot sleeve; and a plunger means for ejecting molten material from said bore, said plunger means movable between a retracted position wherein said pour hole is unrestricted and an extended position toward said lower end of said shot sleeve, said shot sleeve defining a first volume above a first horizontal plane through said lower extent and forward of a second plane through said forward extent and generally perpendicular to said sleeve axis, said sleeve defining a second volume below said first plane and between said second plane and a third plane through said rearward extent and generally perpendicular to said sleeve axis, said first and second volumes being generally equal, whereby, when said sleeve is filled with molten metal to said lower extent of said pour hole, subsequent movement of said plunger from said retracted position to said extended position causes the molten metal within said second volume to displace any air within said first volume.

8. The system of claim 7 wherein said plunger includes a tip chamfered at an angle generally equal to the angle of inclination of said shot sleeve.

9. The system of claim 8 wherein said shot sleeve includes an inner surface chamfered at said lower end at an angle generally equal to said angle of inclination of said shot sleeve.

10. The system of claim 9 wherein said shot sleeve includes a shot volume, said shot sleeve being rotatable to allow adjustment of said shot volume.

11. A shot sleeve for delivering molten material to a cavity, comprising:

a circumferential wall defining an inclined internal bore and a pour hole communicating with said bore, said pour hole including a spillway and having a forward extent and a rearward edge, said spillway having a lower extent;

wherein said shot sleeve is inclined and said pour hole is disposed such that a first volume bounded by said wall, a first plane extending perpendicular to an axis of said bore at said forward extent, and a second plane extending perpendicular to said axis at said rearward edge is equal to a second volume bounded by said wall, a horizontal plane at said lower extent of said spillway, and said second plane, said second volume above said horizontal plane.

12. The sleeve of claim 11 wherein said lower extent of said spillway is aligned with said rearward edge along a plane generally perpendicular to said axis, said spillway allowing excess molten material to spill from said shot sleeve.

13. The sleeve of claim 12 wherein said wall includes a forward end and an inner surface; and wherein said inner surface is chamfered at said forward end at an angle at least equal to said incline of said shot sleeve.

14. A die casting metal delivery system comprising:

a shot sleeve having longitudinal axis inclined from the horizontal to define upper and lower ends, said upper end defining a pour hole having a forward extent and a rearward extent; and a plunger tip reciprocable within said shot sleeve between (a) a retracted position wherein said plunger tip is proximate said upper end and said pour hole is open and (b) an extended position wherein said plunger tip is proximate said lower end;

said shot sleeve defining a first volume above a first horizontal plane through said lower extent and forward of a second plane through said lower extent and generally perpendicular to said sleeve axis, said shot sleeve defining a second volume between said second plane and a third plane through said forward extent and generally perpendicular to said sleeve axis, said first and second volumes being generally equal whereby, when said sleeve is filled with molten metal to said lower extent of said pour hole, subsequent movement of said plunger from said retracted position to said extended position causes the molten metal within said second volume to displace any air within said first volume without causing the molten metal to spurt from said pour hole as said plunger closes said pour hole.

* * * * *